US007331146B1

(12) United States Patent
Beutler et al.

(10) Patent No.: US 7,331,146 B1
(45) Date of Patent: Feb. 19, 2008

(54) WINDOW AND DOOR JAMB ADJUSTMENT SYSTEM

(75) Inventors: William A. Beutler, Moorhead, MN (US); Gary O. Berg, Detroit Lakes, MN (US)

(73) Assignee: B3 Products, Inc., Detroit Lakes, MN (US)

( * ) Notice: Subject to any disclaimer, the term of this patent is extended or adjusted under 35 U.S.C. 154(b) by 516 days.

(21) Appl. No.: 10/881,199

(22) Filed: Jun. 29, 2004

(51) Int. Cl.
*E06B 3/96* (2006.01)
*E06B 1/04* (2006.01)

(52) U.S. Cl. ..... 52/204.56; 49/505

(58) Field of Classification Search ..... 52/217, 52/204.56, 126.1, 126.3, 126.4; 248/188.2, 248/188.4, 298.1, 295.11; 49/505
See application file for complete search history.

(56) References Cited

U.S. PATENT DOCUMENTS

| | | | | |
|---|---|---|---|---|
| 1,622,022 | A | 3/1927 | Brennen | |
| 1,643,871 | A | 9/1927 | Butcher | |
| 1,643,921 | A | 9/1927 | Butcher | |
| 1,689,519 | A | 10/1928 | Connors | |
| 1,974,637 | A | 9/1934 | Axe | 189/73 |
| 2,114,910 | A | 4/1938 | Shattuck | 292/305 |
| 2,571,477 | A | 10/1951 | Osten, Sr. | 20/12 |
| 2,600,072 | A | 6/1952 | Peremi | 189/73 |
| 3,553,891 | A * | 1/1971 | Casebolt et al. | 49/505 |
| 3,626,639 | A | 12/1971 | Di Lucia | 49/505 |
| 4,372,082 | A | 2/1983 | Pagel | 49/62 |
| 4,453,346 | A * | 6/1984 | Powell et al. | 49/404 |
| 4,558,536 | A | 12/1985 | Dunsmoor | 49/404 |
| 4,858,865 | A * | 8/1989 | Schrepfer | 248/188.2 |
| 4,870,791 | A | 10/1989 | Nelson | 52/217 |
| 4,947,594 | A * | 8/1990 | Theobald et al. | 52/126.4 |
| 5,655,342 | A | 8/1997 | Guillemet et al. | 52/217 |
| 5,655,343 | A * | 8/1997 | Seals | 52/217 |
| 5,692,350 | A | 12/1997 | Murphy, Jr. | 52/213 |
| 6,216,402 | B1 * | 4/2001 | Van de Laar | 52/217 |
| 6,405,501 | B1 | 6/2002 | Cerrato | 52/217 |

OTHER PUBLICATIONS

Dean Lumber & Supply, Dean-lunber.com, Website Printout, Jun. 20, 2004, 2 pages.

* cited by examiner

*Primary Examiner*—Richard E. Chilcot, Jr.
*Assistant Examiner*—Ryan D Kwiecinski

(57) ABSTRACT

A window and door jamb adjustment system for accurately installing windows and doors and providing for later adjustment of the same. The window and door jamb adjustment system includes a support member attachable to a building frame, an alignment member slidably attached to the support member and attachable to an extension jamb, a door or window, and a threaded shaft attached to the support member and threadably engaging the alignment member. As the threaded shaft is rotated, the rotational motion is converted to linear motion of the alignment member. As the alignment member is moved with respect to the support member, the extension jamb, a door or window, is correspondingly moved inwardly or outwardly for proper alignment with plasterboard.

17 Claims, 12 Drawing Sheets

WINDOW AND DOOR JAMB ADJUSTMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to the installation of windows and doors, and more specifically it relates to a window and door jamb adjustment system for accurately installing windows and doors and providing for later adjustment of the same.

2. Description of the Related Art

The installation of doors and windows has been done for years. Conventional methods of installation require the installer to "guess" where the plasterboard will be so the extension jambs of the window/door are substantially flush to the plasterboard. Unfortunately, since the windows/doors are typically installed before the installation of the plasterboard, errors occur resulting in an extension jamb that is not flush to the plasterboard (e.g. extends out or recess from the plasterboard). If the extension jamb extends out from the plasterboard, the installer must typically plane the extension jamb to be flush with the plasterboard and then refinish the extension jamb. If the extension jamb is recessed with respect to the plasterboard, the installer must then adjust the entire window/door to properly align the extension jamb with the plasterboard. In some situations, it is necessary to completely replace the window extension jambs. All of these follow-up processes are time consuming and costly.

In these respects, the window and door jamb adjustment system according to the present invention substantially departs from the conventional concepts and designs of the prior art, and in so doing provides an apparatus primarily developed for the purpose of accurately installing windows and doors.

BRIEF SUMMARY OF THE INVENTION

In view of the foregoing disadvantages inherent in the known types of windows and doors now present in the art, the present invention provides a new window and door jamb adjustment system construction wherein the same can be utilized for accurately installing windows and doors.

To attain this, the present invention generally comprises a support member attachable to a building frame, an alignment member slidably attached to the support member and attachable to an extension jamb, a window or door, and a threaded shaft attached to the support member and threadably engaging the alignment member. As the threaded shaft is rotated, the rotational motion is converted to linear motion of the alignment member. As the alignment member is moved with respect to the support member, the extension jamb, a window or door, is correspondingly moved for proper alignment.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a window and door jamb adjustment system that will overcome the shortcomings of the prior art devices.

A second object is to provide a window and door jamb adjustment system for accurately installing windows and doors.

Another object is to provide a window and door jamb adjustment system that enables construction contractors to install windows/doors accurately at the time the windows/doors are installed.

An additional object is to provide a window and door jamb adjustment system that reduces the amount of time and expense required to realign extension jambs.

A further object is to provide a window and door jamb adjustment system that improves the appearance of windows and doors by ensuring proper alignment of the extension jambs.

Another object is to provide a window and door jamb adjustment system that eliminates the need for planning, refinishing or replacing extension jambs.

Another object is to provide a window and door jamb adjustment system that provides a finish carpenter with an efficient means for making last minute adjustments to a window or door.

Another object is to provide a window and door jamb adjustment system that allows a window or door manufacturer to sell jambs that are non-planeable (e.g. veneer jambs, etc.).

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
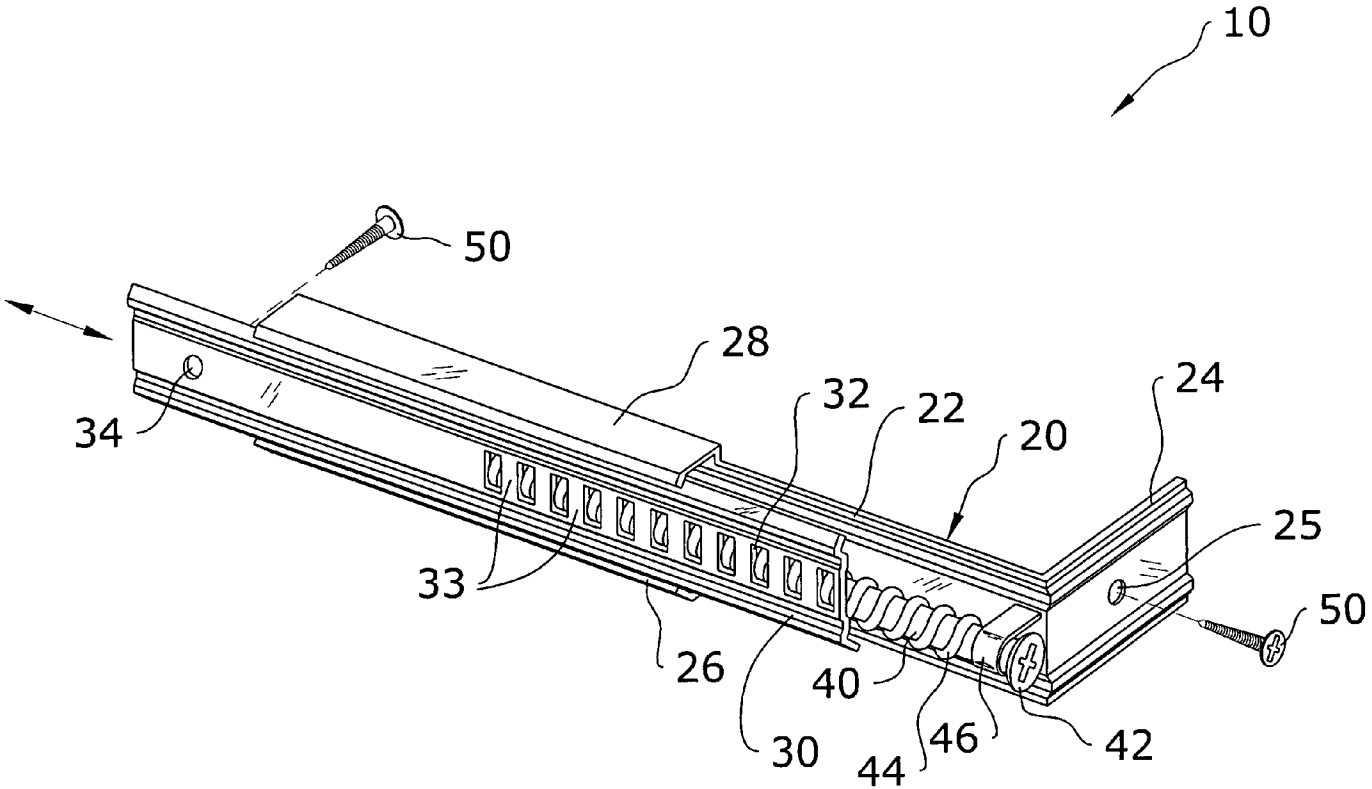
FIG. 1 is an upper perspective view of the present invention.

Turning now descriptively to the drawings, in which similar reference characters denote similar elements throughout the several views, FIGS. 1 through 12 illustrate a jamb adjuster 10, which comprises a support member 20 attachable to a building frame 18, an alignment member 30 slidably attached to the support member 20 and attachable to an extension jamb 16, a window 12 or door 14, and a threaded shaft 40 attached to the support member 20 and threadably engaging the alignment member 30. As the threaded shaft 40 is rotated, the rotational motion is converted to linear motion of the alignment member 30. As the alignment member 30 is moved with respect to the support member 20, the extension jamb 16, a door 14 or window 12, is correspondingly moved for proper alignment.

B. Support Member

Figure 3:
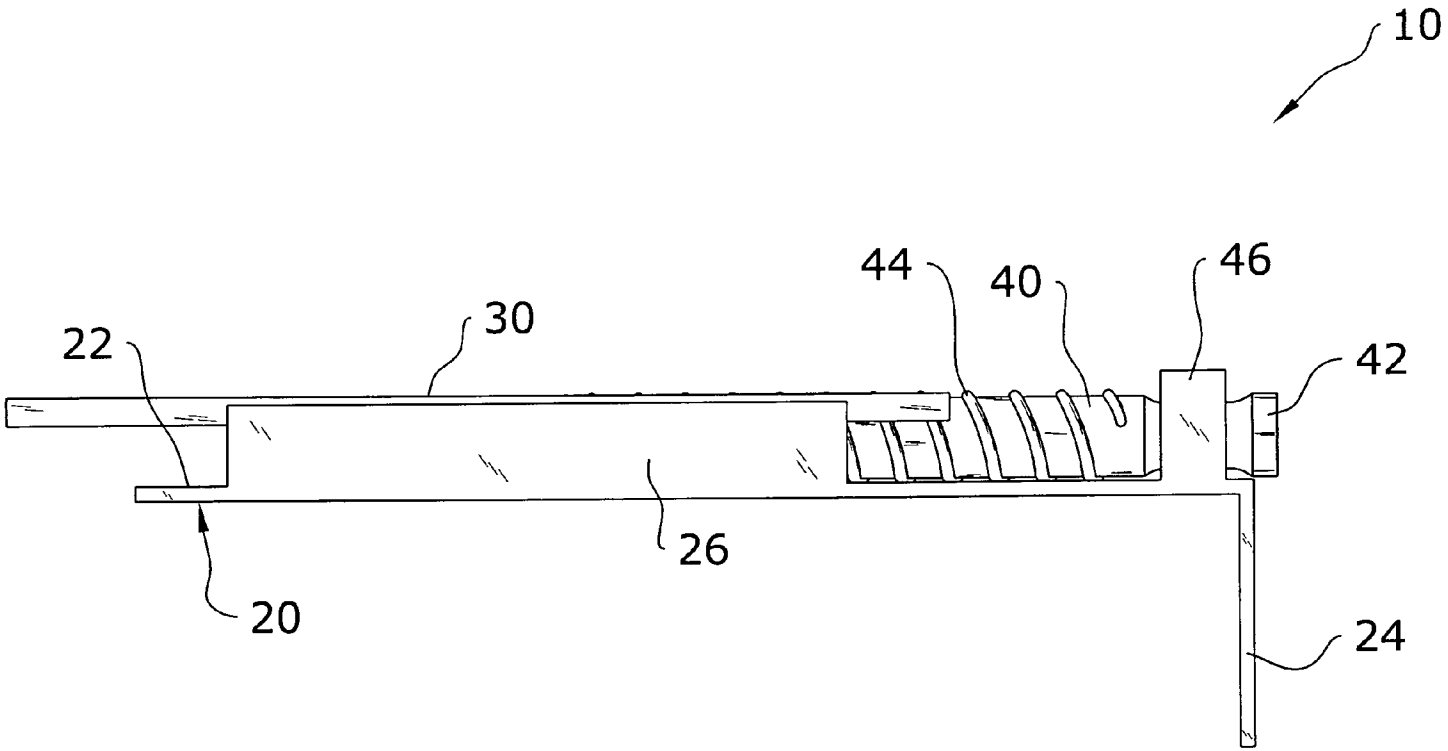
FIG. 3 is a top view of the present invention.

The support member 20 is attachable to a building frame 18 adjacent to the extension jamb 16 of the window 12 or door 14. The support member 20 is preferably comprised of a first segment 22 and a second segment 24 as shown in FIGS. 1 and 3 of the drawings. The second segment 24 of the support member 20 preferably extends substantially orthogonal from the first segment 22 forming an L-shaped structure as best illustrated in FIG. 3 of the drawings.

The first segment 22 is preferably substantially longer than the second segment 24 as best illustrated in FIG. 3 of the drawings. The first segment 22 is substantially straight and substantially flat to allow for fitting between the extension jamb 16 and the building frame 18. The first segment 22 is preferably substantially parallel to the alignment member 30 as illustrated in FIG. 3 of the drawings.

Figure 4:
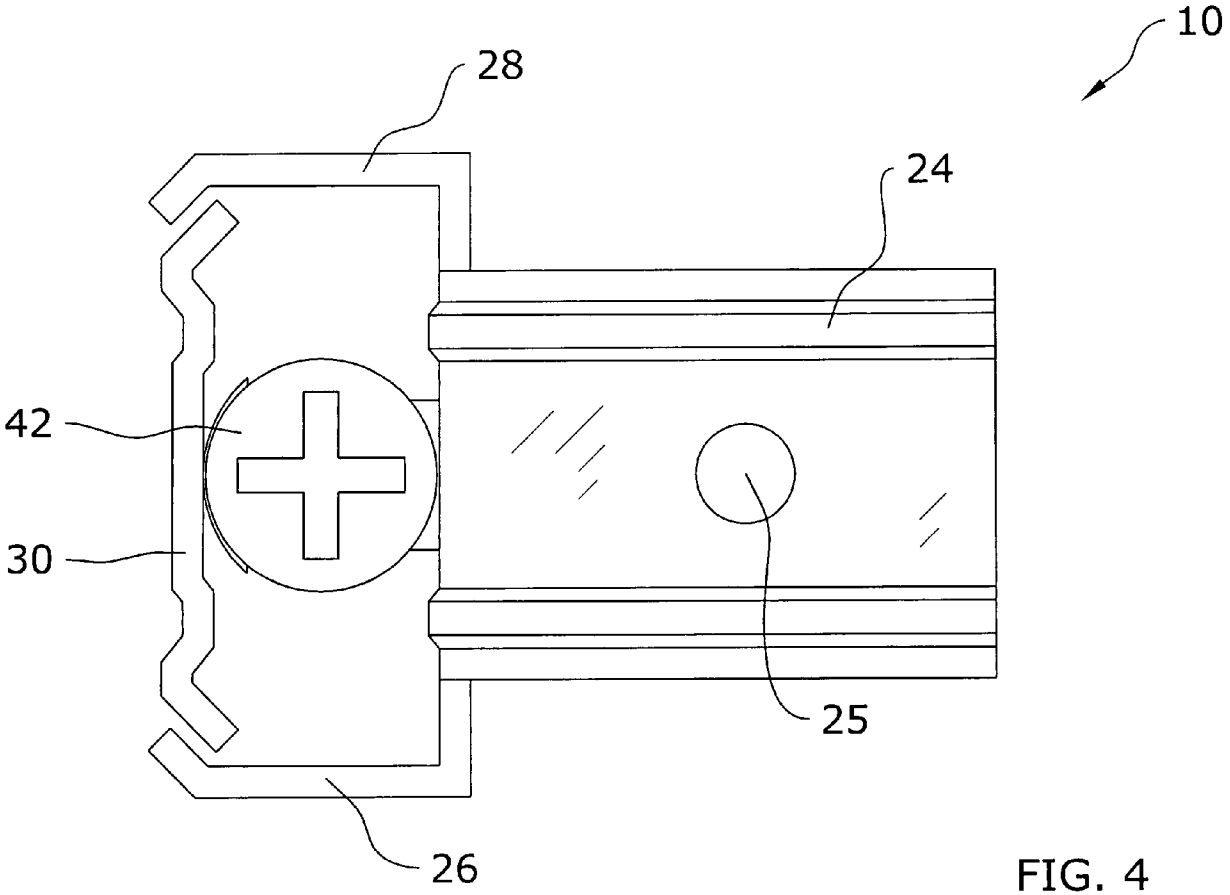
FIG. 4 is a front end view of the present invention.
Figure 5:
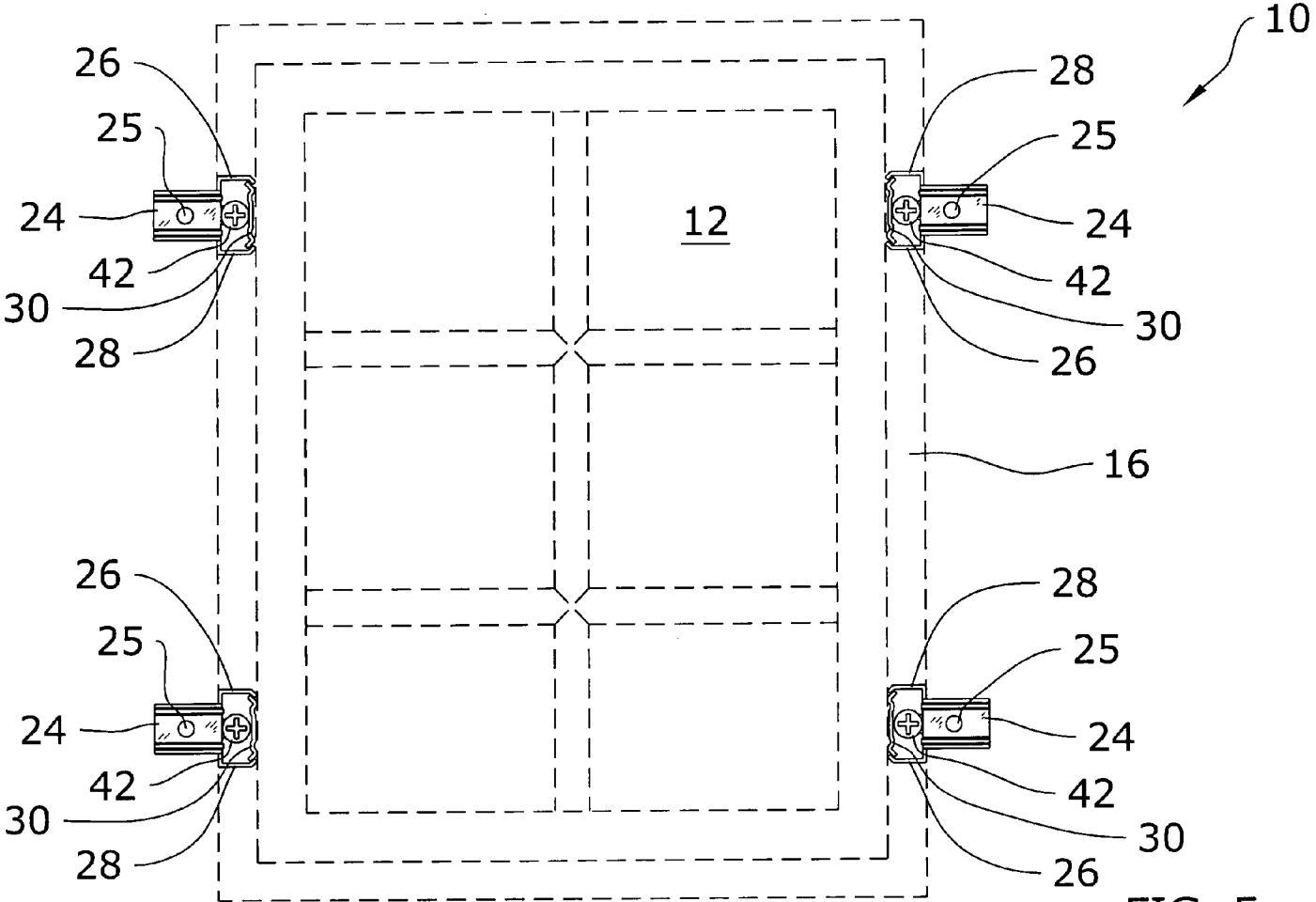
FIG. 5 is a front view of the present invention attached to a window.
Figure 6:
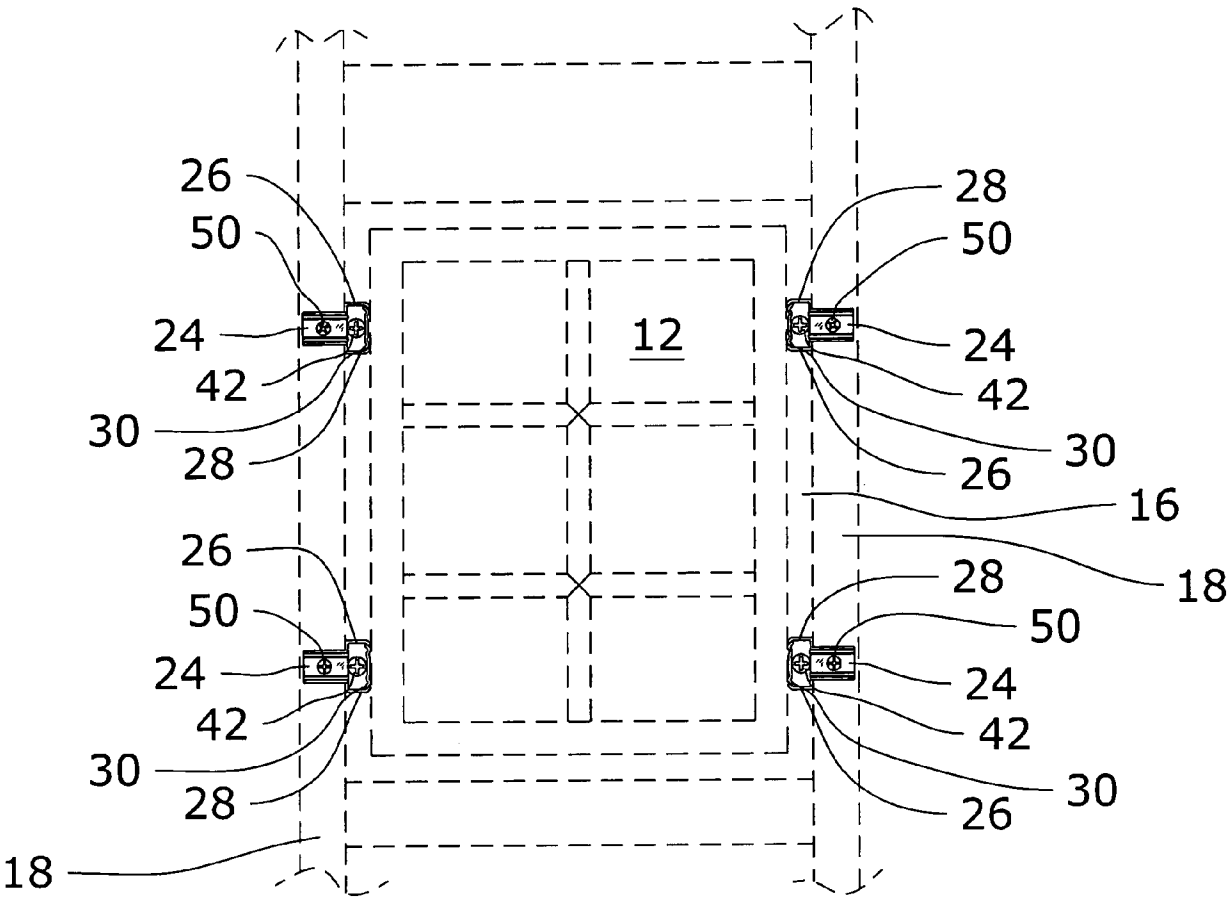
FIG. 6 is a front view of the present invention attached between a window and a building frame.
Figure 7:
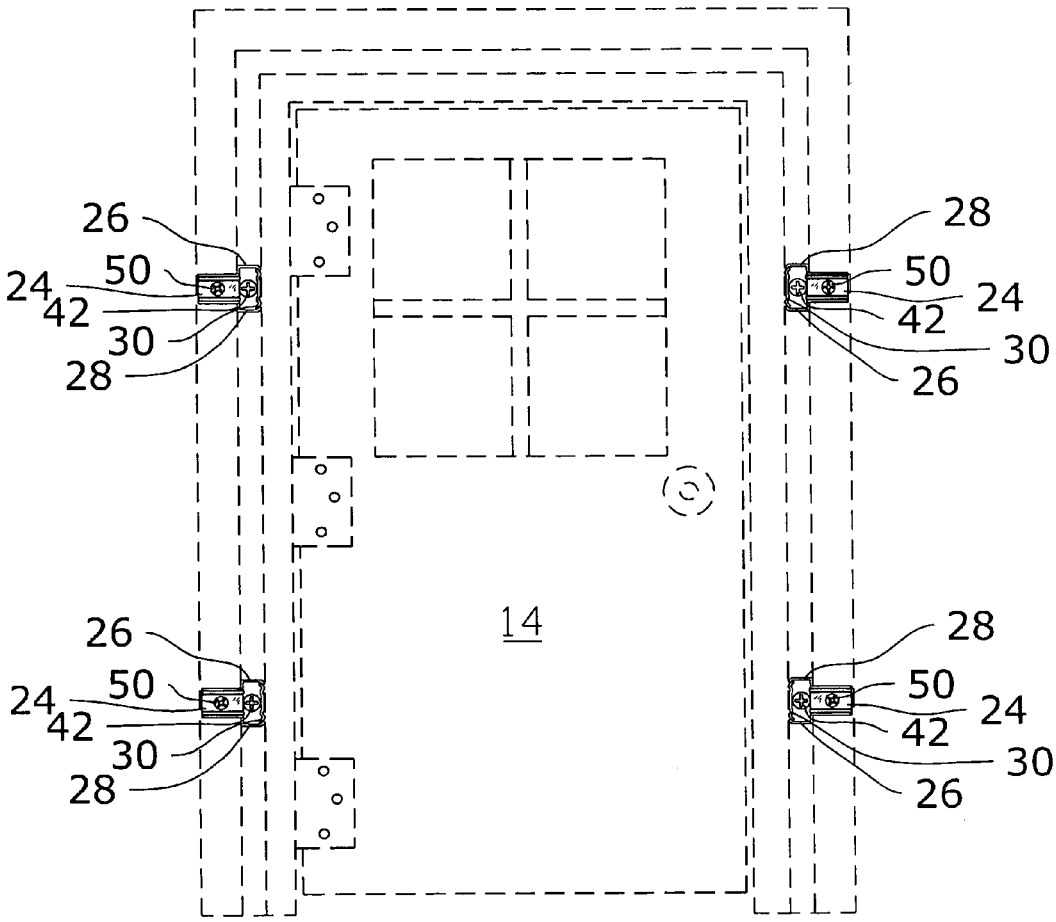
FIG. 7 is a front view of the present invention attached between a door and a building frame.

The second segment 24 also preferably includes at least one support aperture 23 for receiving a fastener 50 as shown in FIGS. 1 and 4 of the drawings. The second segment 24 is preferably approximately 2 inches in length to correspond to a conventional 2×4 (or 2×6, etc.) board of the building frame 18.

Figure 2:
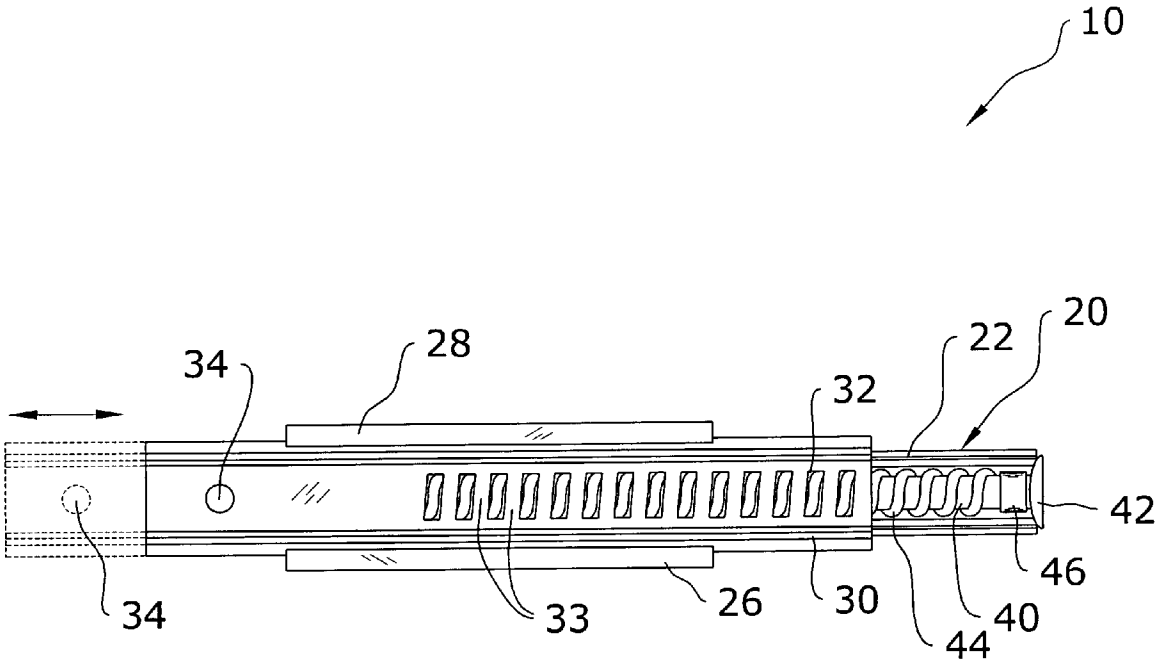
FIG. 2 is a side view of the present invention.
Figure 8:
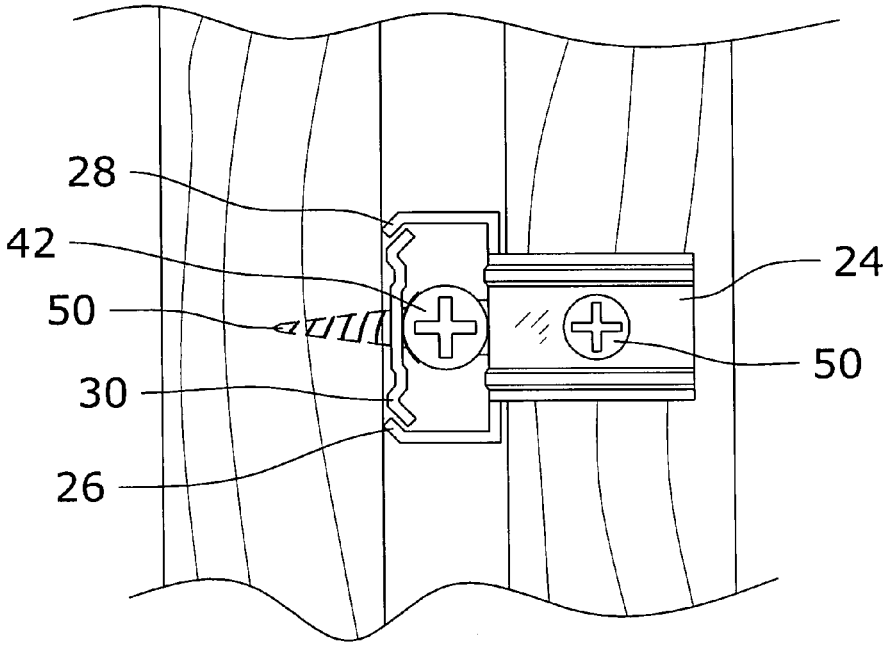
FIG. 8 is a magnified front view of the present invention attached between the extension jamb and the building frame.
Figure 9:
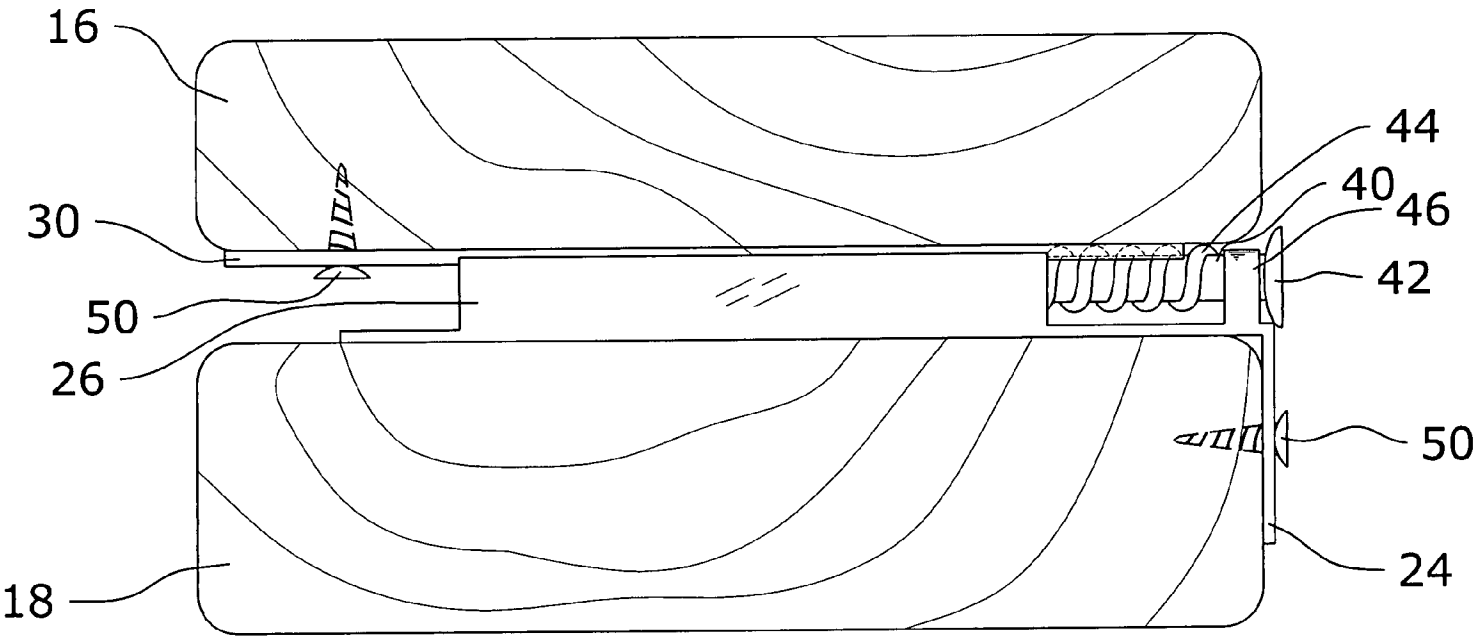
FIG. 9 is a magnified top view of the present invention attached between the extension jamb and the building frame.

A first guide 26 and a second guide 28 are preferably attached to the support member 20 that slidably receive the alignment member 30 between thereof as shown in FIGS. 1, 2 and 4 of the drawings. The first guide 26 and the second guide 28 are preferably in opposition to one another and preferably each have an inwardly tapered distal portion as best illustrated in FIG. 4 of the drawings. The first guide 26 and the second guide 28 are preferably substantially flush with respect to an outer surface of the alignment member 30 to prevent interference with the movement of the extension jamb 16 as shown in FIGS. 4 and 8 of the drawings.

C. Alignment Member

The alignment member 30 is slidably attached to the support member 20 and is attachable to an extension jamb 16, a door 14 or window 12. The alignment member 30 further preferably includes at least one alignment aperture 34 for securing the alignment member 30 to the extension jamb 16, the door 14 or window 12 as shown in FIGS. 1 and 2 of the drawings.

The alignment member 30 includes a plurality of alignment slots 32 that receive a portion of the threading 44 of the threaded shaft 40 thereby forming teeth 33 between each of the alignment slots 32 as shown in FIGS. 1 and 2 of the drawings. The teeth 33 may also be formed by extending the same inwardly towards the threaded shaft 40 without having to utilize a plurality of alignment slots 32.

The alignment member 30 is preferably comprised of a substantially straight and substantially flat structure as shown in FIGS. 1 through 4 of the drawings. The upper and lower portions of the alignment member 30 are preferably tapered inwardly to correspond to the distal portions of the guides 26, 28 as best illustrated in FIG. 4 of the drawings.

D. Threaded Shaft

The threaded shaft 40 is rotatably attached to the support member 20 and threadably engages the alignment member 30 as shown in FIGS. 1 through 4 of the drawings. The rotary motion of the threaded shaft 40 is converted to linear motion of the alignment member 30 similar to a rack and pinion. For example, if the threaded shaft 40 is rotated clockwise, the alignment member 30 is pulled outwardly. If the threaded shaft 40 is rotated counter-clockwise, the alignment member 30 is drawn inwardly. It can be appreciated that the rotary motion of the threaded shaft 40 causing linear motion of the alignment member 30 can be changed by simply reversing the threading 44.

The threaded shaft 40 preferably includes an engaging head 42 that allows for the manipulation of the threaded shaft 40 by a conventional tool (e.g. screwdriver, socket, wrench). The threaded shaft 40 has a length of threading 44 that engages the teeth 33 of the alignment member 30 as shown in FIGS. 1 and 2 of the drawings. The threading 44 may have various pitches that correspond to the teeth 33.

A brace 46 is attached to the support member 20 for rotatably receiving the threaded shaft 40 as illustrated in FIGS. 1 through 3 of the drawings. The brace 46 prevents the threaded shaft 40 from moving linearly while allowing the threaded shaft 40 to freely rotate. Various other securing structures may be utilized to rotatably support the threaded shaft 40 with respect to the support member 20. The distal portion of the threaded shaft 40 may also be rotatably supported to the support member 20 using a brace 46 or similar structure.

E. Operation of Invention

Figure 10:
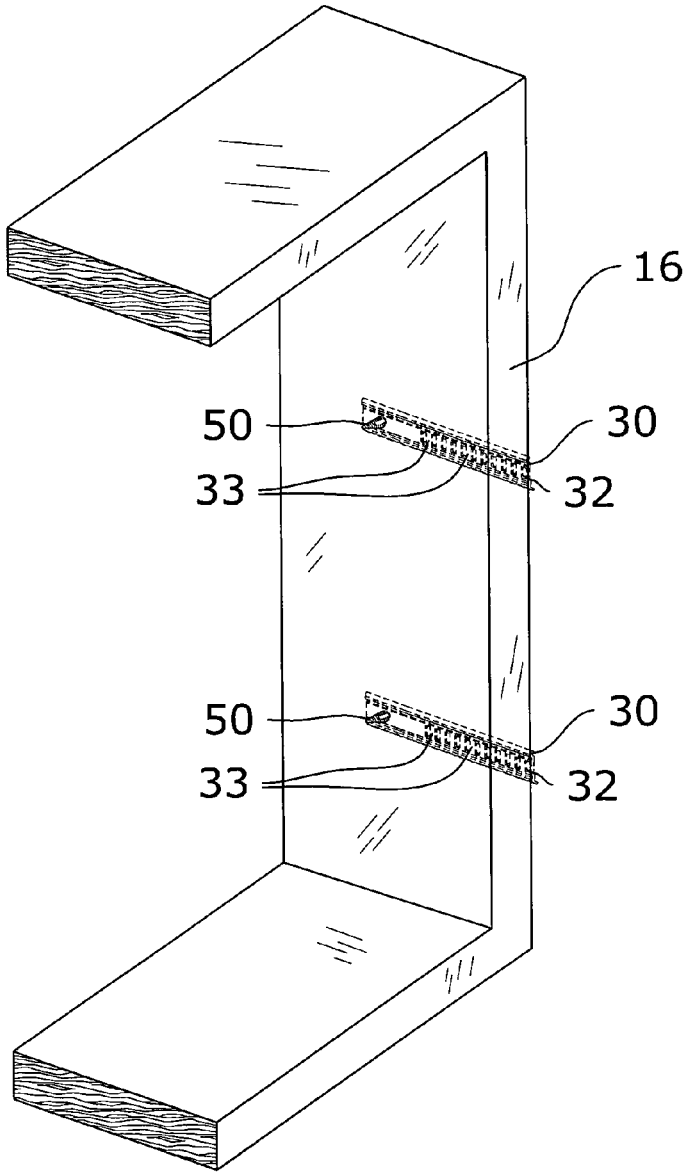
FIG. 10 is an upper perspective view of the present invention attached to an extension jamb.

The alignment member 30 of each of the jamb adjusters 10 are each attached to an extension jamb 16, a window 12 or door 14 as shown in FIG. 10 of the drawings. The jamb adjusters 10 may be attached at the sides, the upper portion and the lower portion of the extension jamb 16, a door 14 or window 12 to provide sufficient support for the door 14 or window 12. To attach the jamb adjusters 10 to the extension jamb 16, one or more conventional fasteners 50 are extended through the alignment aperture 34 within the alignment member 30 and into the extension jamb 16, a window 12, or door 14.

Figure 11:
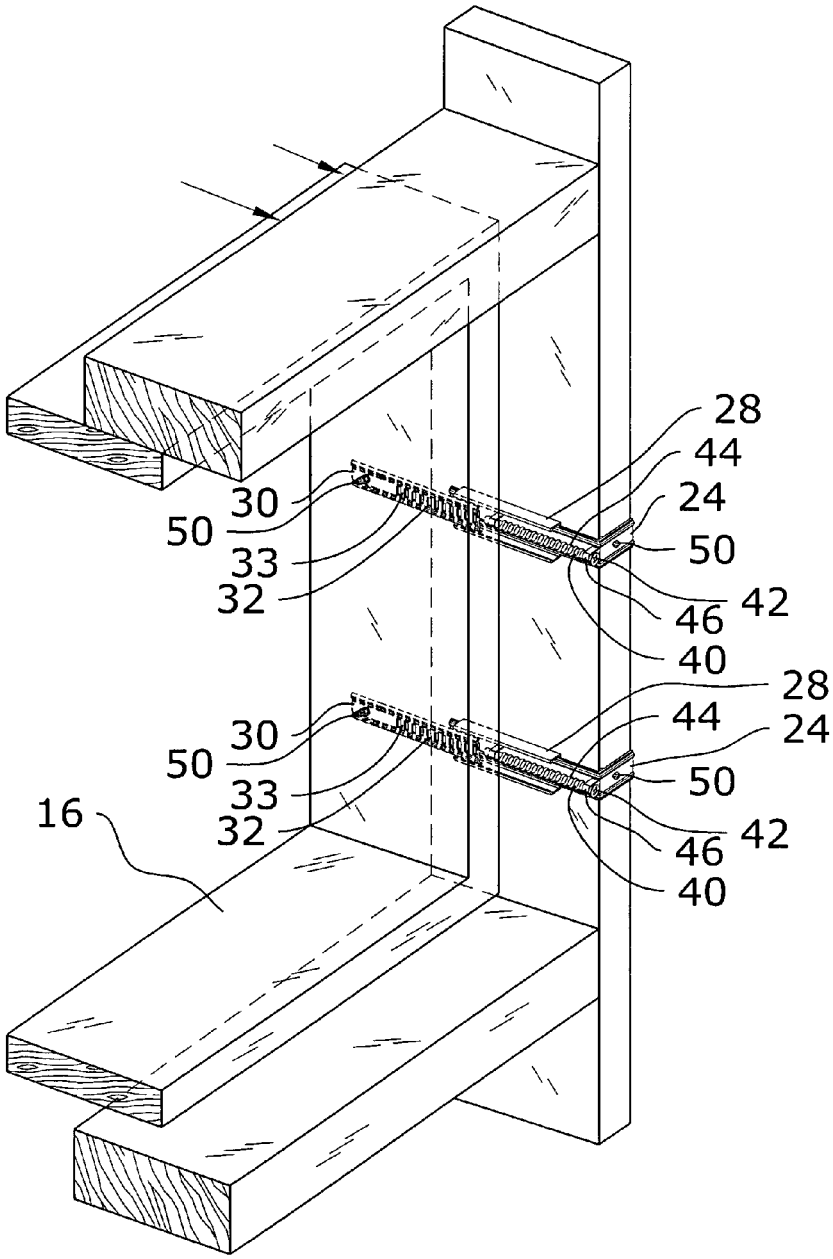
FIG. 11 is an upper perspective view of the present invention attached between the extension jamb and a building frame.
Figure 12:
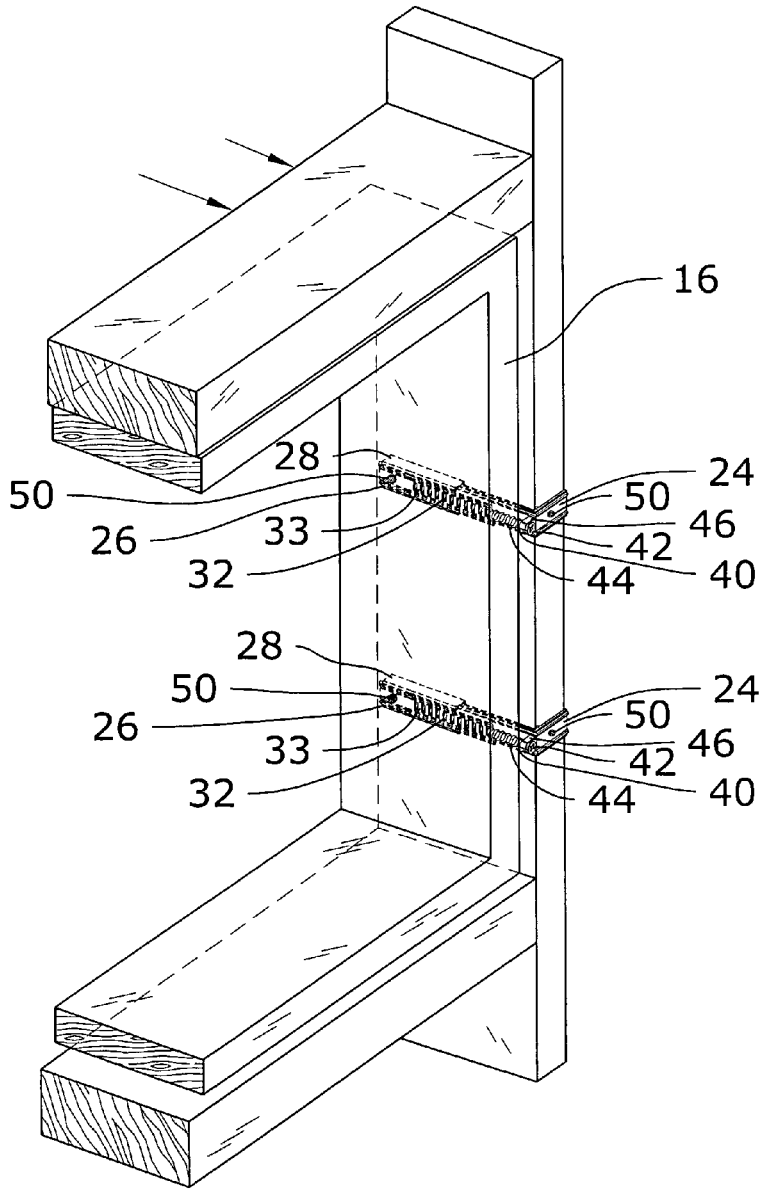
FIG. 12 is an upper perspective view of the present invention attached between the extension jamb and a building frame with the extension jamb pulled forwardly.

After the jamb adjusters 10 are properly attached to the extension jamb 16, the window 12 or door 14 with its corresponding extension jamb 16 is positioned within an opening within the building frame 18 where the window 12 or door 14 are to be permanently mounted as shown in FIG. 11 of the drawings. The support member 20 is then attached to the building frame 18 by extending one or more conventional fasteners 50 into the support aperture 23 within the support member 20. The user is then able to rotate the threaded shaft 40 to cause the extension jamb 16 to be extended or recessed with respect to the building frame 18 as shown in FIG. 12 of the drawings. After the plasterboard is secured to the building frame 18 about the window 12 or door 14, the extension jamb 16 can be easily readjusted by simply rotating the threaded shaft 40 to cause the desired movement of the alignment member 30. After the extension jamb 16 is properly positioned within respect to the plasterboard, the extension jamb 16 can be non-movably attached within the building frame 18 with nails or other fasteners 50.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A window and door jamb adjustment apparatus for installing and adjusting a position of an extension jamb of a window or door, comprising:

a support member attachable to a building frame;

an alignment member slidably attached to said support member and attachable to an extension jamb, a door or window; and a threaded shaft rotatably attached to said support member and threadably engaging said alignment member, wherein the rotary motion of said threaded shaft is converted to linear motion of said alignment member; and a first guide and a second guide attached to said support member that slidably receive said alignment member;

wherein said first guide and said second guide are substantially flush with respect to an outer surface of said alignment member.

2. The window and door jamb adjustment apparatus of claim 1, wherein said support member is comprised of a first segment and a second segment extending substantially orthogonally from said first segment.

3. The window and door jamb adjustment apparatus of claim 2, wherein said first segment is substantially longer than said second segment.

4. The window and door jamb adjustment apparatus of claim 2, wherein said second segment is less than two-inches in length.

5. The window and door jamb adjustment apparatus of claim 2, wherein said first segment and said second segment form an L-shaped structure.

6. The window and door jamb adjustment apparatus of claim 2, wherein said first segment is substantially straight.

7. The window and door jamb adjustment apparatus of claim 2, wherein said first segment is substantially flat.

8. The window and door jamb adjustment apparatus of claim 2, wherein said second segment includes at least one support aperture.

9. The window and door jamb adjustment apparatus of claim 2, wherein said first segment is substantially parallel to said alignment member.

10. The window and door jamb adjustment apparatus of claim 1, wherein said first guide and said second guide are in opposition to one another.

11. The window and door jamb adjustment apparatus of claim 1, wherein said first guide and said second guide each have an inwardly tapered distal portion.

12. The window and door jamb adjustment apparatus of claim 1, wherein said alignment member includes a plurality of alignment slots that receive a portion of the threading of said threaded shaft thereby forming teeth between thereof.

13. The window and door jamb adjustment apparatus of claim 1, wherein said alignment member includes a plurality of teeth that engage a threading of said threaded shaft.

14. The window and door jamb adjustment apparatus of claim 1, wherein said threaded shaft includes an engaging head that allows for the manipulation of said threaded shaft by a tool.

15. The window and door jamb adjustment apparatus of claim 1, including a brace attached to said support member for rotatably receiving said threaded shaft.

16. The window and door jamb adjustment apparatus of claim 15, wherein said brace prevents said threaded shaft from moving linearly.

17. A window and door jamb adjustment apparatus for installing and adjusting a position of an extension jamb of a window or door, comprising:

a support member attachable to a building frame, wherein said support member is comprised of a first segment and a second segment extending substantially orthogonally from said first segment forming an L-shaped structure;

wherein said first segment is substantially longer than said second segment, wherein said first segment is substantially straight and substantially flat;

wherein said second segment includes at least one support aperture for receiving a fastener;

an alignment member slidably attached to said support member and attachable to an extension jamb, a door or window, wherein said alignment member includes a plurality of alignment slots that receive a portion of a threading of a threaded shaft thereby forming teeth between thereof;

wherein said first segment is substantially parallel to said alignment member;

a first guide and a second guide attached to said support member that slidably receive said alignment member, wherein said first guide and said second guide are in opposition to one another, wherein said first guide and said second guide each have an inwardly tapered distal portion, and wherein said first guide and said second guide are substantially flush with respect to an outer surface of said alignment member;

a threaded shaft rotatably attached to said support member and threadably engaging said alignment member, wherein the rotary motion of said threaded shaft is converted to linear motion of said alignment member, and wherein said threaded shaft includes an engaging head that allows for the manipulation of said threaded shaft by a tool; and a brace attached to said support member for rotatably receiving said threaded shaft, wherein said brace prevents said threaded shaft from moving linearly while allowing said threaded shaft to freely rotate.

* * * * *